United States Patent [19]

Szema

[11] Patent Number: 4,465,284

[45] Date of Patent: Aug. 14, 1984

[54] SCALLOPED COOLING OF GAS TURBINE TRANSITION PIECE FRAME

[75] Inventor: Li-Chieh Szema, Schenectady, N.Y.

[73] Assignee: General Electric Company, Schenectady, N.Y.

[21] Appl. No.: 533,565

[22] Filed: Sep. 19, 1983

[51] Int. Cl.[3] ..... F16J 15/16; F16J 15/44; F01D 5/08

[52] U.S. Cl. ..... 277/22; 277/53; 415/178; 415/180

[58] Field of Search ..... 277/22, 53–57; 415/175–178, 180

[56] References Cited

U.S. PATENT DOCUMENTS

| | | | |
|---|---|---|---|
| 2,992,842 | 7/1961 | Shevchenko et al. | 277/22 X |
| 3,411,794 | 11/1968 | Allen | 415/178 X |
| 3,516,757 | 6/1970 | Baumann | 415/175 X |
| 4,307,993 | 12/1981 | Hartel | 415/178 X |

FOREIGN PATENT DOCUMENTS

| | | | |
|---|---|---|---|
| 2610783 | 9/1977 | Fed. Rep. of Germany | 415/180 |
| 1237157 | 6/1960 | France | 415/176 |

*Primary Examiner*—Robert S. Ward
*Attorney, Agent, or Firm*—J. C. Squillaro

[57] ABSTRACT

A plurality of flow channels permit a controlled flow of compressed air to flow therein in contact with the flange of a gas turbine combustor transition piece to reduce the operational temperature of the flange and to thereby reduce stress creep distortion of the flange. The flow channels may be disposed in a surface of the flange facing a seal member or in a surface of the seal member facing the flange. In one embodiment, a longitudinal slot in the flange permits the entry of a sealing flange or seal plate. The flow channels may be disposed in the surface of the slot or in the surface of the flange or seal plate. In another embodiment of the invention, the seal member embraces the exterior of the flange and the flow channels may be disposed in either of the facing surfaces.

18 Claims, 12 Drawing Figures

SCALLOPED COOLING OF GAS TURBINE TRANSITION PIECE FRAME

BACKGROUND OF THE INVENTION

The present invention relates to gas turbines and, more particularly, to apparatus for cooling a sealing frame of a gas turbine combustor transition piece.

A gas turbine conventionally includes a compressor to compress ambient air to relatively high pressure. The compressed air is mixed with fuel in a combustor where the fuel is burned to produce a high-temperature energetic flow of uncombusted air and products of combustion. This flow is employed to drive a turbine which, in turn, provides power to drive the compressor and may also turn an output shaft or be directed through a nozzle to produce thrust.

In industrial gas turbines, the combustion of fuel takes place in a plurality of burner cans tangentially spaced about the apparatus. The hot gases from the conventionally cylindrical burner cans are directed to the turbine stage through transition pieces which, in concert, convert the plurality of cylindrical flow fields from the burner cans into a substantially uniform 360 degree annular flow field entering the turbine stage. The burner cans and the transition pieces are disposed in a plenum containing the compressed air from the compressor.

The downstream ends of the transition pieces are shaped so that, when assembled into a 360 degree assembly, their outer and inner perimeters form concentric circles. The transverse edges of adjacent transition pieces abut to form radii of the concentric circles. In order to prevent leakage of compressed air past the downstream ends of the assembled transition pieces, outward-directed flanges are provided at the downstream ends of the transition pieces each forming a frame. Seals engage the flanges at the outer and inner perimeters of the concentric circles as well as between adjacent transition pieces.

One of the problems limiting the working life of transition pieces is stress creep deflection of the transition piece frame. Such stress creep deflection is believed to be caused by the elevated temperature in the vicinity of the sealing portions of the transition piece frame. With time in use, the distortion of the transition piece frame becomes so great that excessive leakage flow of compressed air from the plenum passes the seals and enters the flow of hot gases entering the turbine stage. This leakage flow is capable of distorting the temperature profile of the hot gases exiting the transition piece in an unpredictable way, making it cooler in some regions of the flow field and hotter in other regions. This distortion of the temperature profile is capable of compromising the life of downstream parts.

OBJECTS AND SUMMARY OF THE INVENTION

Accordingly, it is an object of the invention to provide an apparatus for reducing the stress creep distortion of the transition piece frame of a gas turbine.

It is a further object of the invention to provide an apparatus for reducing the temperature of a transition piece frame whereby the thermal stress thereof is reduced.

It is a further object of the invention to provide a means for providing a controlled flow of cooling air in contact with a transition piece frame whereby its temperature is lowered.

According to an embodiment of the invention, there is provided a seal for sealing a combustor transition piece to an adjacent structure for limiting a leakage flow of compressed air therepast comprising at least one flange on the transition piece, a seal member, first means on the seal member for sealingly engaging at least one surface on the flange, second means on the seal member for sealingly engaging the adjacent structure and a plurality of flow channels in at least one of facing surfaces of the flange and the first means, the plurality of flow channels being effective for permitting a controlled flow of the compressed air to flow in contact with the facing surface of the flange whereby the flange is cooled.

According to a feature of the invention, there is provided a seal for sealing at least one of an inner panel flange and an outer panel flange of a gas turbine transition piece to an adjacent structure for limiting a leakage flow of compressed air therepast comprising at least one radially directed surface on the flange, a seal member, first means on the seal member for sealingly engaging the adjacent structure, a surface on the seal member disposed sealingly close to the at least one radially directed surface, and a plurality of flow channels in at least one of facing surfaces of the radially directed surface and the surface on the seal member, the plurality of flow channels being effective for permitting a controlled flow of the compressed air to flow therethrough in contact with the flange whereby the flange is cooled.

According to a further feature of the invention, there is provided a seal for sealing at least one of an inner panel flange and an outer panel flange of a gas turbine transition piece to an adjacent structure for limiting a leakage flow of compressed air therepast comprising at least one radially directed slot in the flange, a seal member, first means on the seal member for sealingly engaging the adjacent structure, a radially directed flange on the seal member sealably fittable in the radially directed slot, and a plurality of flow channels in at least one of facing surfaces of the radially directed slot and the radially directed flange, the plurality of flow channels being effective for permitting a controlled flow of the compressed air to flow therethrough in contact with the flange whereby the flange is cooled.

According to a still further feature of the invention, there is provided a seal for sealing adjacent first and second side panel flanges of first and second gas turbine transition pieces, comprising a first slot in the first flange, a second slot in the second flange, the first and second slots being aligned, a seal plate sealingly fittable into the first and second slots, at least one flow channel in a first surface of the seal plate, at least a second flow channel in a second surface of the seal plate, the at least a second flow channel being displaced in a lengthwise direction from the at least a first flow channel and at least one indent in an edge of the seal plate communicating with the at least one and the at least a second flow channel whereby a flow of compressed air in one of the at least one and the at least a second flow channel is enabled to pass the edge and reach the other thereof.

According to yet another feature of the invention, there is provided a seal for sealing adjacent aligned first and second side panel flanges of adjacent first and second gas turbine transition pieces, comprising an H-shaped seal member having first and second longitudinal slots therein separated by a crossbar, the slot being sealingly fittable over the first flange, the second slot being sealingly fittable over the second flange, at least one flow channel in at least one of a surface of the first slot facing a surface of the first side panel flange and a surface of the side panel flange facing a surface of the first slot, the at least one flow channel being effective for permitting a controlled flow of compressed air therethrough in contact with the surface of the first side panel flange, at least a second flow channel in at least one of a surface of the second slot facing a surface of the second side panel flange and a surface of the second side panel flange facing a surface of the side panel flange, the at least a second flow channel being effective for permitting a controlled flow of compressed air therethrough in contact with the surface of the second side panel flange and means for admitting compressed air to upstream portions of the first and second slots.

Briefly stated, the present invention provides a plurality of flow channels which permit a controlled quantity of compressed air to flow therein in contact with the flange of a gas turbine combustor transition piece to reduce the operational temperature of the flange and to thereby reduce thermal stress of the flange. The flow channels may be disposed in a surface of the flange facing a seal member or in a surface of the seal member facing the flange. In one embodiment, a longitudinal slot in the flange permits the entry of a sealing flange or seal plate. The flow channels may be disposed in the surface of the slot or in the surface of the flange or seal plate. In another embodiment of the invention, the seal member embraces the exterior of the flange and the flow channels may be disposed in either of the facing surfaces.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
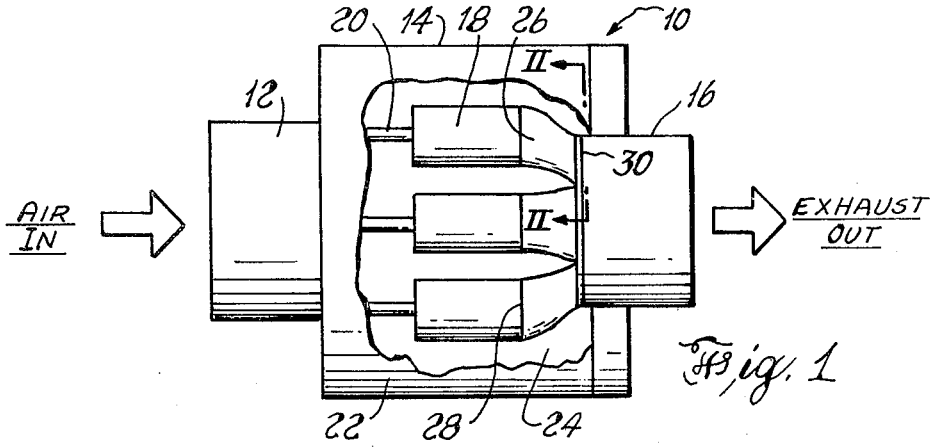
FIG. 1 is a simplified diagram of a side view of a portion of a gas turbine in which the combustor section wrapper has been cut away to reveal internal details.

Referring now to FIG. 1 there is shown, generally at 10, a gas turbine from which extraneous details such as piping, intake section and outlet section have been omitted in order to avoid clutter. Gas turbine 10 includes a compressor section 12 which is effective to compress incoming air to a high pressure for delivery to a combustor section 14. Fuel is burned with the compressed air in combustor section 14 to produce a hot, energetic flow of products of combustion and uncombusted air to a turbine section 16 wherein the hot gas flow is effective to rotate a turbine wheel (not shown) for driving compressor section 12 as well as for optionally rotating an output shaft (not shown) or for producing thrust. Since the apparatus in compressor section 12, combustor section 14 and turbine section 16 is conventional except as hereinafter described, further detail of such conventional apparatus is omitted.

Combustor section 14 contains a plurality of combustor cans 18 arranged in a circle about a center line of combustor section 14 with each receiving a supply of fuel on a fuel supply line 20. Combustor section 14 is sealed by a wrapper to form a substantially sealed plenum 24 receiving the compressed air from compressor section 12 and supplying it to combustor cans 18 through apertures (not shown) in the wrappers thereof to provide both combustion air and cooling air in their interiors.

Although FIG. 1 illustrates a combustor section 14 containing six combustor cans 18 (three of which are visible, the other three are hidden) with associated elements, more or less combustor cans 18 may be employed. Large industrial gas turbines 10 may employ, for example, twelve, eighteen or more combustor cans 18 in order to obtain sufficient hot gases.

In order to conduct the hot gases from combustor cans 18 to turbine section 16 and to reshape the gas flow from a plurality of circular flow fields to a substantially continuous 360-degree annular flow field, the output of each combustor can 18 is passed through a transition piece 26 which joins its associated combustor can 18 at a liner seal 28 which both seals against the loss of hot gases and also permits relative motion of the joined parts to compensate for differential thermal expansion. Seals 30 at the downstream end of transition piece 26 seal plenum 24 against excessive loss of compressed air. Transition pieces 26 are conventionally cast of a high-temperature metal alloy such as, for example, Hastalloy which is capable of withstanding temperatures as high as about 1500 to 1600 degrees F. The hot gases exiting transition pieces 26 may approach and even exceed this temperature, particularly in the vicinity of seals 30 and could lead to corrosion of the material. At temperatures lower than, but approaching these values, stress distortion of transition pieces 26 in the vicinity of seal 30 may limit their lives. The present invention is directed toward providing a controlled flow of cooling air in this area.

Figure 2:
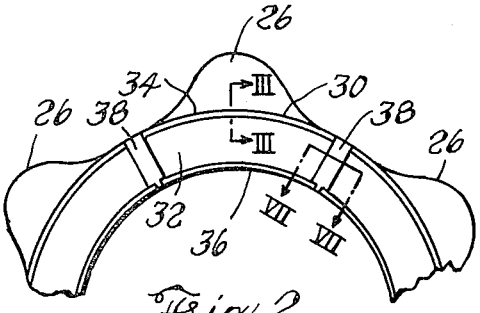
FIG. 2 is a view taken in the direction indicated by II—II in FIG. 1.

Referring now to FIG. 2, each transition piece 26 is seen to terminate in an exit orifice 32 surrounded by seal 30. Seal 30 includes an outer panel seal 34 at an outer extremity of exit orifice 32, an inner panel seal 36 at an inner extremity of exit orifice 32 and a side panel seal 38 at each side of exit orifice 32. Either one or both of outer panel seal 34 and inner panel seal 36 may employ an embodiment of the invention. When both outer panel seal 34 and inner panel seal 36 employ an embodiment of the invention, they may employ the same embodiment or they may employ different embodiments. Each of the embodiments adaptable to outer panel seal 34 and inner panel seal 36 are described in connection with outer panel seal 34, it being understood that each may be equally applicable to inner panel seal 36.

Figure 3:
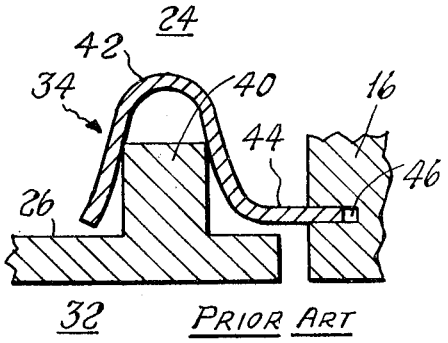
FIG. 3 is a cross section taken along III—III of FIG. 2 showing an outer panel seal according to the prior art.

Referring now to FIG. 3, there is shown a radial cross section through an outer panel seal 34 according to one design of the prior art. An outward-directed flange 40 on transition piece 26 is embraced by a sheet metal floating seal 42. The closeness of fit between flange 40 and 42 is sufficient to substantially seal against passage of compressed air from plenum 24 to exit orifice 32 therepast except for a small amount of leakage air which is useful for cooling flange 40. Unfortunately, the amount of leakage air past flange 40 is difficult to control in the device of the prior art and the amount tends to change with time as a thermally induced stress creep in transition piece 26 distorts flange 40. A downstream flange 44 on floating seal 42 enters a sealing slot 46 in turbine section 16 to further seal against the passage of compressed air.

Figure 4:
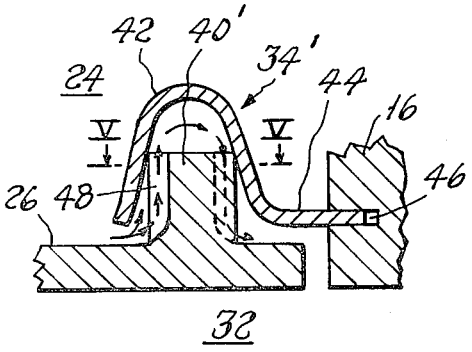
FIG. 4 is a cross section corresponding to FIG. 3 showing an outer panel seal according to an embodiment of the invention.
Figure 5:
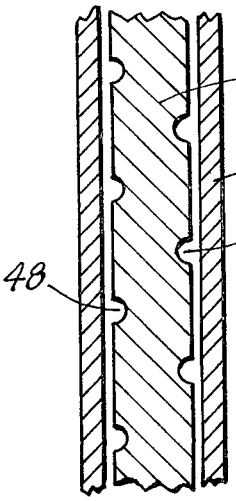
FIG. 5 is a cross section taken along V—V of FIG. 4

Referring now to FIG. 4, there is shown an outer panel seal 34' according to one embodiment of the invention. A flange 40' includes a plurality of flow channels 48 in an upstream surface and a downstream surface thus providing a controlled flow of cooling compressed air passing in contact with flange 40' for cooling thereof. Referring now also to FIG. 5, it is seen that flow channels 48 in the upstream surface of flange 40' are offset from flow channels 48 in the downstream surface of flange 40'. This provides improved uniformity of cooling in the lengthwise direction of flange 40'. The flow capacity of flow channels 48 may be adjusted by establishing their spacing, width and depth according to the particular application. A temperature reduction in flange 40' of as much as 100 degrees F. or more may be achieved.

It would be clear to one skilled in the art with the present disclosure before him that, instead of placing flow channels 48 on the surfaces of flange 40', corresponding flow channels 48 (not shown) could be incorporated into the surfaces of floating seal 42 facing flange 40'. In customary embodiments, the thickness of material in floating seal 42 may be too small to permit such an alternative. Such an alternative could, of course, be employed by forming floating seal 42 of thicker material to enable forming flow channels 48 therein. The important concept being that flow channels are provided in contact with flange 40' having defined capacities and shapes effective to cool flange 40' without the use of excessive wasted airflow. A cooling airflow of less than one percent of the total compressed airflow should be sufficient to cool flange 40'.

Figure 6:
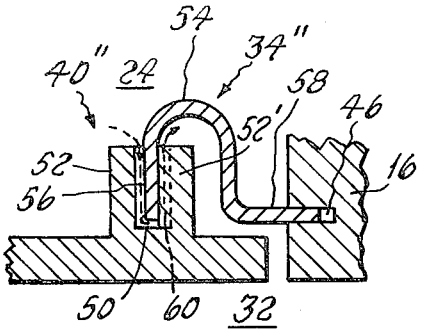
FIG. 6 is a cross section corresponding to FIG. 3 showing an outer panel seal according to a further embodiment of the invention.

Referring now to FIG. 6, a different embodiment of a fluted outer panel seal 34'' is shown. In this embodiment, a flange 40'' is divided by a slot 50 into a pair of parallel flanges 52 and 52'. A floating seal 54 includes a radially directed flange 56 fitting sealingly into slot 50 and an axially directed flange 58 fitting into sealing slot 46 in turbine section 16. A plurality of flow channels 60 are provided at least in the downstream face of slot 50 on radially directed flange 56' for cooling radially directed flange 56' with a controlled stream of cooling air. An additional plurality of flow channels 62 may optionally be provided in the face of flanges 52 and 52' facing radially directed flange 56 to further enhance cooling. In the preferred embodiment, however, only flow channels 60 in flanges 52 and 52'' are provided since it is more important to cool the one of flanges 52 and 52' and flanges 52 and 52'' which is closer to turbine section 16.

Figure 7:
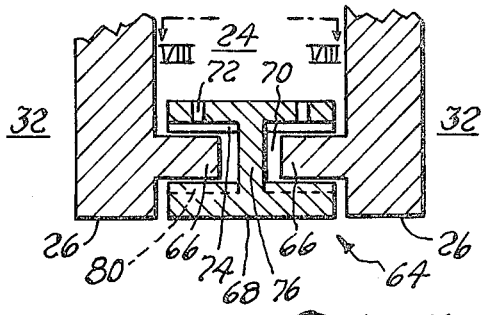
FIG. 7 is a cross section taken along VII—VII of FIG. 2 showing a side panel seal according to an embodiment of the invention.

Returning momentarily to FIG. 2, side panel seal 38 may be implemented in two embodiments generally corresponding in principle to the two embodiments described for outer panel seal 34' and outer panel seal 34''. That is, one embodiment provides a sealing member which fits over the outer perimeters of adjacent flanges and another embodiment employs a sealing member which fits into aligned slots in adjacent flanges. In both embodiments, appropriately sized and spaced flow channels either in the flanges or in the sealing member provide a controlled flow of cooling compressed air in contact with surfaces of the flanges effective for cooling the flanges. FIG. 7 is a tangential cross section taken along VII—VII of FIG. 2 through a side panel seal 64 of the first-mentioned type. An end flange 66 extends outward from a transition piece 26 toward a corresponding end flange 66 aligned therewith extending outward from an adjacent transition piece 26. An H-shaped seal member 68 includes first and second slots 70 which respectively enclose corresponding end flanges 66 of their transition pieces 26.

Figure 8:
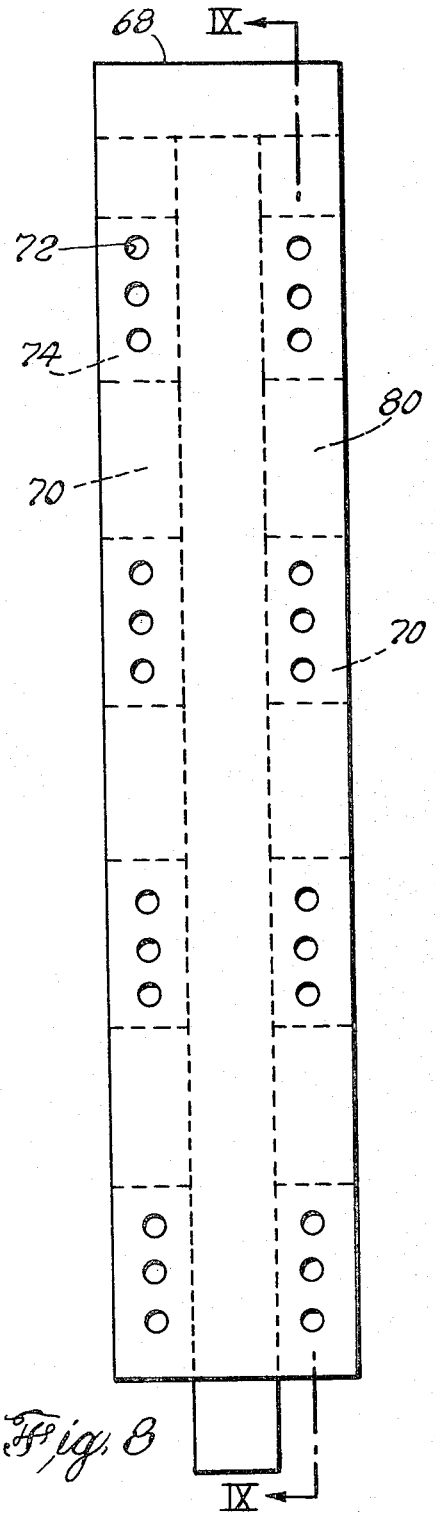
FIG. 8 is a view taken in the direction indicated by VIII—VIII in FIG. 7.
Figure 9:
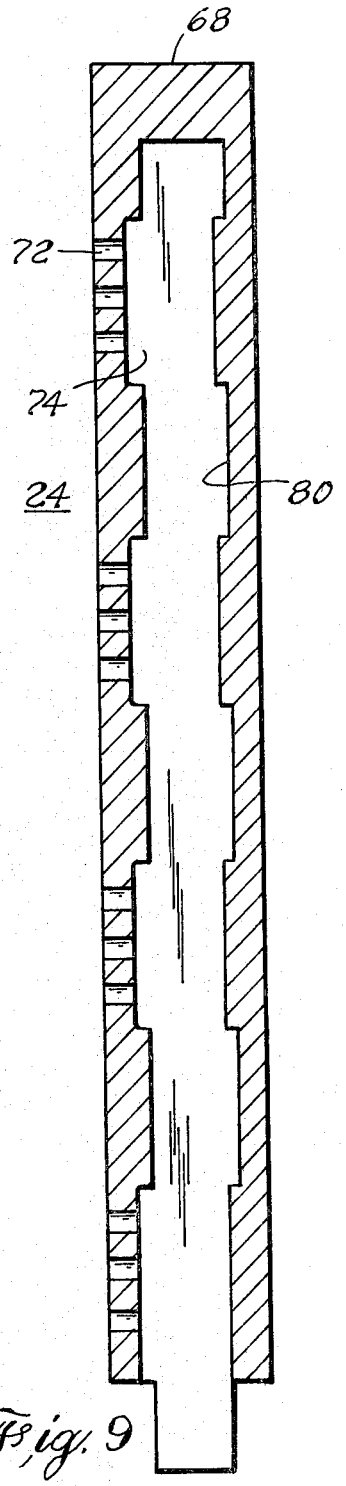
FIG. 9 is a cross section taken along IX—IX in FIG. 8.

Referring now also to FIGS. 8 and 9, a plurality of air entry holes 72 permits entry of compressed air from plenum 24 (FIG. 7) into flow channels 74 on upstream inner surfaces of slots 70. Compressed air is thereby enabled to flow in contact with an upstream surface of end flange 66 toward a crossbar 76 of H-shaped seal member 68. A further plurality of flow channels 80 are disposed in the downstream surfaces of slots 70 for again flowing the compressed air in contact with downstream surfaces of end flanges 66 before discharging it into the gas stream flowing into turbine section 16 (not shown in FIGS. 7, 8 and 9). The cooling compressed air entering turbine section 16 produces minimum degradation in operational efficiency not only because the quantity of air is small but also because it is uniformly distributed in a controlled manner which is less subject to change with time. For these reasons, there is also substantially reduced interference with the temperature profile of gases reaching downstream elements and thus reduced likelihood of damage in such downstream elements from this cause.

Figure 11:
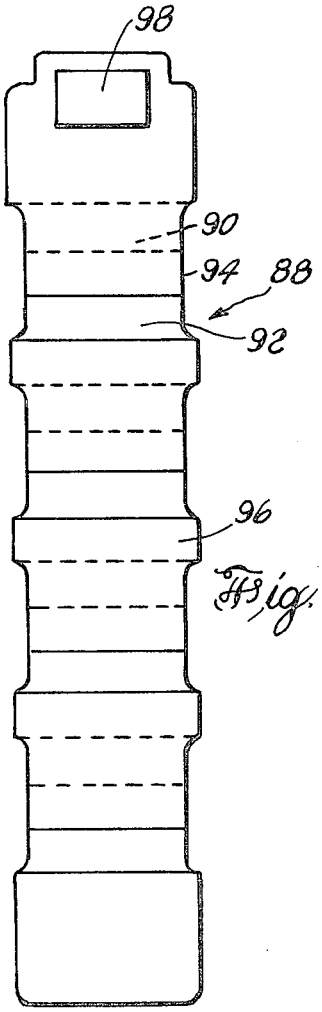
FIG. 11 is a side view of a sealing plate of FIG. 10.
Figure 10:
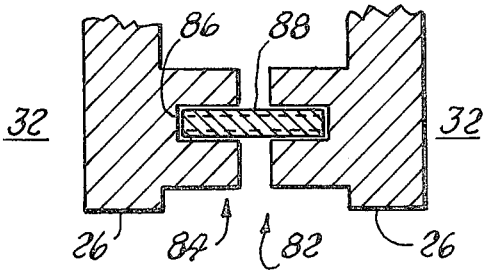
FIG. 10 is a cross section taken along VII—VII in FIG. 2 showing a side panel seal according to a further embodiment of the invention.
Figure 12:
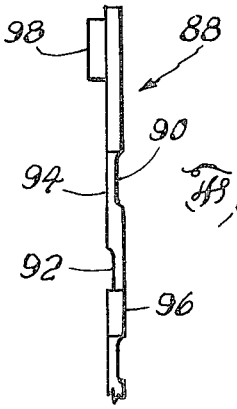
FIG. 12 is a side view of the sealing plate of FIG. 11.

Referring now to FIG. 10, there is shown the other type of a side panel seal 82. Each of facing flanges 84 includes an aligned slot 86. A seal plate 88 is fitted into aligned slots 86 for accomplishing side panel sealing. Referring now also to FIGS. 11 and 12, seal plate 88, which is preferably of a high-temperature metal such as stainless steel, includes a plurality of flow channels 90 on an upstream surface and a further plurality of flow channels 92 on a downstream surface thereof. In order to permit air to flow around the edge of seal plate 88, both edges of seal plate 88 contain flow channels 92 bridging an adjacent pair of flow channel 90 and flow channel 92. Indents 94 are separated by full-width lands 96 which are effective to maintain seal plate 88 centered in slots 86 and also to provide alignment and support to the associated transition pieces 26. A locating boss 98 may be disposed on one surface of seal plate 88 as shown for cooperation with a mating element (not shown) on one or both of flanges 84. Other types of locating boss 98 such as, for example, an end of seal plate 88 bent to form a hook (not shown) may also be used without departing from the scope of the invention.

When a hook is provided, it has the additional advantage of offering a means for grasping seal plate 88 to assist in the removal thereof.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A seal for sealing a combustor transition piece to an adjacent structure for limiting a leakage flow of compressed air therepast comprising:

at least one flange on said transition piece;

a seal member;

first means on said seal member for sealingly engaging a surface on said flange;

second means on said seal member for sealingly engaging said adjacent structure; and a plurality of flow channels in at least one of facing surfaces of said flange and said first means, said plurality of flow channels being effective for permitting a controlled flow of said compressed air to flow in contact with said facing surface of said flange whereby said flange is cooled.

2. A seal member according to claim 1 wherein said at least one surface includes an upstream surface and a downstream surface and said facing surface of said flange being at least said downstream surface.

3. A seal member according to claim 2 wherein said flange includes a slot therein, said upstream surface includes an upstream surface of said slot, said downstream surface includes a downstream surface of said slot and said first means includes a portion of said seal member sealably fittable into said slot.

4. A seal member according to claim 3 wherein said adjacent structure includes a second combustor transition piece, said second transition piece including a second flange, said second flange including a second slot aligned with said first-mentioned slot, and said portion of said seal member sealably fittable into said slot includes a seal plate fittable into said first-mentioned and said second slot.

5. A seal member according to claim 4 wherein said plurality of flow channels include a first plurality of flow channels spaced apart in a lengthwise direction in a first surface of said seal plate and a second plurality of flow channels spaced apart in a lengthwise direction in a second surface of said seal plate, each of said flow channels in said first plurality being intermediate in a lengthwise direction of said seal plate an adjacent pair of flow channels of said second plurality of flow channels, said seal plate further including at least one indent in an edge thereof, said at least one indent bridging at least one flow channel of said first plurality of flow channels and at least one flow channel of said second plurality of flow channels whereby a flow of compressed air in an upstream one of said first and second pluralities of flow channels is enabled to move past an edge of said seal plate to flow in the other of said first and second pluralities of flow channels.

6. A seal according to claim 1 wherein said adjacent structure includes a turbine stage of a gas turbine, said second means including a slot in said turbine stage and a downstream flange on said seal sealingly engaged in said slot.

7. A seal according to claim 6 wherein said flange includes an upstream outer surface and a downstream outer surface, said first means including a surface of said seal disposed sealingly close to at least one of said upstream surface and said downstream surface.

8. A seal according to claim 6 wherein said flange includes a radially directed slot therein and said first means includes a radially directed flange thereon sealingly insertable into said radially directed slot, said at least one facing surface including at least one of a surface of said slot facing said radially directed flange and a face of said radially directed flange facing a surface of said slot.

9. A seal for sealing at least one of an inner panel flange and an outer panel flange of a gas turbine transition piece to an adjacent structure for limiting a leakage flow of compressed air therepast comprising:

at least one radially directed surface on said flange;

a seal member;

first means on said seal member for sealingly engaging said adjacent structure;

a surface on said seal member disposed sealingly close to said at least one radially directed surface; and a plurality of flow channels in at least one of facing surfaces of said radially directed surface and said surface on said seal member, said plurality of flow channels being effective for permitting a controlled flow of said compressed air to flow therethrough in contact with said flange whereby said flange is cooled.

10. A seal according to claim 9 wherein said facing surface includes an upstream surface of said flange and a downstream surface of said flange.

11. A seal for sealing at least one of an inner panel flange and an outer panel flange of a gas turbine transition piece to an adjacent structure for limiting a leakage flow of compressed air therepast comprising:

at least one radially directed slot in said flange;

a seal member;

first means on said seal member for sealingly engaging said adjacent structure;

a radially directed flange on said seal member sealably fittable in said radially directed slot; and a plurality of flow channels in at least one of facing surfaces of said radially directed slot and said radially directed flange, said plurality of flow channels being effective for permitting a controlled flow of said compressed air to flow therethrough in contact with said flange whereby said flange is cooled.

12. A seal for sealing adjacent first and second side panel flanges of first and second gas turbine transition pieces, comprising:

a first slot in said first flange;

a second slot in said second flange;

said first and second slots being aligned;

a seal plate sealingly fittable into said first and second slots;

at least one flow channel in a first surface of said seal plate;

at least a second flow channel in a second surface of said seal plate, said at least a second flow channel being displaced in a lengthwise direction from said at least a first flow channel; and at least one indent in an edge of said seal plate communicating with said at least one and said at least a second flow channel whereby a flow of compressed air in one of said at least one and said at least a second flow channel is enabled to pass said edge and reach said other thereof.

13. A seal for sealing adjacent aligned first and second side panel flanges of adjacent first and second gas turbine transition pieces, comprising:

an H-shaped seal member having first and second longitudinal slots therein separated by a crossbar;

said slot being sealingly fittable over said first flange;

said second slot being sealingly fittable over said second flange;

at least one flow channel in at least one of a surface of said first slots facing a surface of said first side panel flange and a surface of said side panel flange facing a surface of said first slot, said at least one flow channel being effective for permitting a controlled flow of compressed air therethrough in contact with said surface of said first side panel flange;

at least a second flow channel in at least one of a surface of said second slots facing a surface of said second side panel flange and a surface of said second side panel flange facing a surface of said side panel flange, said at least a second flow channel being effective for permitting a controlled flow of compressed air therethrough in contact with said surface of said second side panel flange; and means for admitting compressed air to upstream portions of said first and second slots.

14. A seal according to claim 13 wherein said at least one flow channel is disposed in a surface of said first slot facing a surface of said first side panel flange and said at least a second flow channel is disposed in a surface of said second slot facing a surface of said second side panel flange.

15. A seal according to claim 14 wherein said surface of said first and second side panel flanges includes at least a downstream surface.

16. A seal according to claim 15 wherein said means for admitting compressed air includes a plurality of holes through an upstream surface of said H-shaped seal member into said first and second slots.

17. A seal according to claim 16 wherein at least some of said plurality of holes communicate with at least some of said at least one and said at least a second flow channels.

18. A seal according to claim 13 wherein said at least one flow channel is disposed in a surface of said first slot facing an upstream surface of said first side panel flange and said at least a second flow channel is disposed in a surface of said second slot facing an upstream surface of said second side panel flange and said means for admitting compressed air includes a plurality of holes through said H-shaped seal member from an upstream location joining at least some of said at least one and said at least a second flow channels.

* * * * *